US008944519B2

(12) United States Patent
Pietrala

(10) Patent No.: US 8,944,519 B2
(45) Date of Patent: Feb. 3, 2015

(54) RACK AND PINION ARRANGEMENT FOR A MINING EXTRACTION MACHINE AND RACK AND PINION ROD THEREFOR

(75) Inventor: Christoph Pietrala, Dortmund (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 276 days.

(21) Appl. No.: 13/384,622

(22) PCT Filed: Jul. 16, 2010

(86) PCT No.: PCT/IB2010/053251

§ 371 (c)(1),
(2), (4) Date: Jan. 18, 2012

(87) PCT Pub. No.: WO2011/010258

PCT Pub. Date: Jan. 27, 2011

(65) Prior Publication Data

US 2012/0111133 A1 May 10, 2012

(30) Foreign Application Priority Data

Jul. 21, 2009 (DE) ..... 20 2009 005 046 U

(51) Int. Cl.

| | |
|---|---|
| ***F16H 1/04*** | (2006.01) |
| ***F16H 55/00*** | (2006.01) |
| ***B61C 1/00*** | (2006.01) |
| ***E21C 29/02*** | (2006.01) |

(52) U.S. Cl.

CPC ..... *E21C 29/02* (2013.01)
USPC ..... 299/43; 74/422; 74/462

(58) Field of Classification Search

USPC ..... 74/422, 89.11, 89.12, 89.17, 89.18, 74/460; 299/43

See application file for complete search history.

(56) References Cited

U.S. PATENT DOCUMENTS

| | | | | |
|---|---|---|---|---|
| 4,051,745 | A * | 10/1977 | Ishikawa | 74/462 |
| 4,222,282 | A * | 9/1980 | Taig | 74/457 |
| 4,773,710 | A * | 9/1988 | Klimeck et al. | 299/43 |
| 4,850,648 | A * | 7/1989 | Muller | 299/43 |
| 2006/0207368 | A1 * | 9/2006 | Hao et al. | 74/422 |

FOREIGN PATENT DOCUMENTS

| | | |
|---|---|---|
| DE | 37 00 489 C1 | 7/1988 |
| DE | 2 111 353 C1 | 5/1998 |
| DE | 197 46 360 A1 | 4/1999 |
| EP | 0851150 B1 | 2/2001 |

* cited by examiner

*Primary Examiner* — William Kelleher
*Assistant Examiner* — Emily Cheng
(74) *Attorney, Agent, or Firm* — Foley & Lardner LLP

(57) ABSTRACT

A rack and pinion arrangement includes rack and pinion rods having a carrier bar, a guide bar and inner rack and pinion teeth for interaction with a driving sprocket. An end tooth at both ends of the each rack and pinion rod has a change in radius of curvature, and the tooth profile of the inner rack and pinion teeth has a change in radius of curvature. The change in radius of curvature of the end teeth is lower than the change in radius of the inner rack and pinion teeth. The end tooth head of the end teeth is lower than the tooth heads of the inner rack and pinion teeth. The end tooth in the region of the change in radius of curvature has a greater tooth width than the inner rack and pinion teeth in the region of the change in radius of curvature.

18 Claims, 4 Drawing Sheets

RACK AND PINION ARRANGEMENT FOR A MINING EXTRACTION MACHINE AND RACK AND PINION ROD THEREFOR

The invention relates to a rack and pinion arrangement (lantern pinion arrangement) for advancing a mining extraction machine provided with a travel drive having a toothed driving sprocket, in particular of a shearer loader, with rack and pinion rods which succeed one another in the longitudinal direction and each consist of a carrier bar, a guide bar and also a plurality of rack and pinion teeth, the tooth flanks of which diverge from one another, for interaction of a tooth profile of the rack and pinion teeth with teeth of the driving sprocket, towards the tooth head and which are arranged with a predefined pitch dimension relative to one another between the carrier bar and the guide bar, a respective end tooth being arranged at both ends of each rack and pinion rod, the end tooth profile of the end tooth differing from the tooth profile of the inner rack and pinion teeth arranged between the end teeth. The invention further relates to a rack and pinion rod for rack and pinion arrangements for advancing mining extraction machines provided with a travel drive having a toothed driving sprocket, in particular shearer loaders, the rack and pinion rod consisting of a carrier bar, a guide bar and also a plurality of rack and pinion teeth having a tooth profile with tooth flanks which diverge from one another, for interaction with teeth of a driving sprocket, towards the tooth head, the rack and pinion teeth being arranged with a predefined pitch dimension relative to one another between the carrier bar and the guide bar and a respective end tooth being arranged at both ends of each rack and pinion rod, the end tooth profile of the end tooth differing from the tooth profile of the inner rack and pinion teeth arranged between the end teeth.

BACKGROUND OF THE INVENTION

Shearer loaders use rack and pinion arrangements for advancing the shearer loader that are usually mounted on the goaf side on a scraper chain conveyor which is arranged and installed in the underground face, thus allowing the shearer loader, as the extraction machine, to be supported on the carrier bars by means of guide shoes and at the same time to guide on the guide rods. The teeth of the toothed wheels of the travel drive engage with the tooth gaps between the rack and pinion teeth in order to convert the rotatory movement of the toothed wheel into a translatory movement of the shearer loader. The rack and pinion arrangement is composed usually of rack and pinion rods, the length of which corresponds substantially to the length of each trough pan of the scraper chain conveyor, thus allowing the scraper chain conveyor, and to this extent also the machine track along with the rack and pinion, to adapt to an undulating course of the extraction face with depressions, saddles and curves. The construction of the rack and pinion arrangement, which is segment-like on account of the individual rack and pinion rods, allows a shearer loader to follow even a curved course of a face conveyor and also the horizontal and/or vertical kinks without becoming blocked.

During operational use of shearer loaders, the rack and pinion rods and also the rack and pinion arrangement as a whole are subject to considerable stresses. Although a fixed pitch dimension between the individual rack and pinion teeth can be ensured within a rack and pinion rod, the vertical and/or horizontal kinking movements of the individual rack and pinion rods, the curved course of the face and the like can lead, in particular at the joining points of adjacent rack and pinion rods, to agitated running of the machine and also to increased stressing of the rack and pinion rods and also the teeth of the driving sprockets.

A rack and pinion arrangement of the type in question with associated rack and pinion rods is known from DE 197 46 360 A1 in the name of the applicant. The known rack and pinion arrangement is successfully used by the applicant under the brand name "JUMBOTRACK" or "JUMBOTRACK 2000" as a system for advancing a shearer loader for extracting coal in underground mining. In the generic rack and pinion arrangement according to DE 197 46 360 A1, to improve the advancement of the shearer loader and also the tooth engagement ratio between the teeth of the driving sprocket and the rack and pinion teeth, the individual rack and pinion teeth have been given a particular tooth profiling which is characterized in that the tooth flanks of adjacent rack and pinion teeth, which tooth flanks diverge from one another towards the tooth head, have a relatively flat flank surface extending so as to be inclined at an angle of from about 8° to 15°, preferably 10° to 12° to the tooth center plane of the individual rack and pinion teeth. The fact that the tooth flanks of the rack and pinion teeth are designed as flat and steeply positioned surfaces allows raising of the extraction machine on account of transverse force components and also the interfering influences resulting therefrom to be to a large extent eliminated. In order at the same time to control problems at the joining points between adjacent rack and pinion rods, use is made, at both ends of the rack and pinion rods of the generic rack and pinion arrangement, of end teeth which are formed unsymmetrically based on their vertical end tooth center plane, the asymmetry being achieved in the generic rack and pinion rods in that the tooth flank of the end teeth that is positioned facing the inner rack and pinion teeth receives in each case a tooth flank extending at a steeper angle relative to the vertical than the tooth flank that is positioned in each case on the outside, i.e. positioned facing the joint of the adjacent rack and pinion rods. This joint-side tooth flank, for its part, is formed identically to the tooth flanks of all the internal rack and pinion teeth. As a result of the unsymmetrical configuration of the end teeth, the tooth pitch of the rack and pinion rod, in each case between two end-side rack and pinion teeth or end teeth of adjacently positioned rack and pinion rods, is increased somewhat over the standard tooth pitch, thus allowing, in particular in the case of rack and pinion rods positioned in an angled manner in relation to one another, the engagement ratios between the driving sprocket on the one hand and the rack and pinion rod on the other hand to be improved and constraints between the mutually meshing tooth flanks to be avoided.

Increasing wear to the tooth shape of the driving sprocket can occur in places after a long operating period in the case of a rack and pinion arrangement according to DE 197 46 360 A1 too. The teeth of the toothed wheel drive are basically subject to higher loads than the rack and pinion teeth, as the teeth of the driving sprockets have to transmit the forces of advancement and each individual tooth enters into tooth engagement with a rack and pinion tooth much more frequently than an individual rack and pinion tooth is loaded as a whole. In the generic rack and pinion rods with asymmetrical end teeth, in-depth analyses have shown that increased wear can occur in particular when the jump from the pitch of one end tooth to that of the other end tooth is at the maximum on account of the play, which is necessarily provided, between adjacent rack and pinion rods. Although the narrower configuration of the adjacently positioned end teeth still allows the driving sprocket to roll off via the end tooth, jamming could occur and led to increased wear at the tips of the teeth. Wear, for example on account of jamming, can lead in particular to sharpening of the teeth of the driving sprocket, thus afterwards then also causing increased wear to the guide shoes with which the shearer loader is guided on the rack and pinion rods.

SUMMARY OF THE INVENTION

An object of the invention is to provide a rack and pinion arrangement, and in particular rack and pinion rods for a rack and pinion arrangement, in which further improved interaction between the teeth of the driving sprocket and the rack and pinion teeth is achieved with at the same time good overrunning of the joining point between adjacently positioned rack and pinion rods.

According to the invention, in a rack and pinion rod arrangement and a rack and pinion rod, this object and others are achieved in that the end teeth are formed symmetrically to a vertical end tooth center plane and in that the tooth head of the end teeth is positioned lower than the tooth heads of the inner rack and pinion teeth or the rack and pinion teeth positioned adjacently to the end teeth of the same rack and pinion rod. The minimized height of the end teeth in relation to the adjacently positioned, inner rack and pinion teeth, or the lower-positioned tooth head of the end teeth, and also the symmetry of the end teeth allow, for both directions of movement of the shearer loader, the driving sprocket to be attached in an improved manner to the end tooth during rolling-off via the joining point or the jump in pitch between adjacently positioned rack and pinion rods and if appropriate to be made to move in an advancing movement, as a result of which the driving sprocket is drawn in an advantageous manner onto the next rack and pinion rod earlier than in the prior art. At the same time, the tooth of the driving sprocket that is positioned in the joint gap between the adjacent rack and pinion rods is able to be positioned freely between both rack and pinion rods and is to this extent not exposed to any increased wear, in particular at this critical point. The minimized and at the same time symmetrical design of the end tooth also prevents, for both directions of movement, jamming of the driving sprocket from occurring, while at the same time the tooth of the driving sprocket that is positioned in the joint gap can overall remain in contact with the end teeth for longer than was the case in the prior art. Improved run-off behaviour is achieved, even when passing through a depression, when the pitch gap between adjacently positioned rack and pinion rods is minimal, as here too sufficient free space still remains for the rolling-past and onward rotation of the tooth of the toothed wheel, which tooth is positioned at any given moment, on both end teeth. The solution according to the invention improves the overall sequence of the rolling-off movement, at both the minimum and the maximum pitch dimension at the joining point between adjacently positioned rack and pinion rods.

The run-off behaviour between the teeth of the driving sprocket and the rack and pinion teeth can also be improved in that rack and pinion teeth are given an altered, modified profiling of the rack and pinion teeth and the end tooth compared to the prior art. For the profiling which is particularly advantageous in accordance with the invention, provision is made for the end teeth to have an end tooth profile with end tooth flanks formed symmetrically to the end tooth center plane, a symmetrically formed end tooth head and a symmetrically formed end tooth foot, and for the inner rack and pinion teeth to have tooth flanks, a tooth head and a tooth foot formed symmetrically to the tooth center plane, the tooth flanks of the rack and pinion teeth extending in each case between the tooth foot and tooth head or the end tooth flanks of the end teeth extending between the end tooth foot and end tooth head in each case with predefined radii of curvature. A curved course of the tooth flanks or end tooth flanks may be of independent inventive importance even without end teeth having a tooth height which is different, as it is smaller, being arranged on a rack and pinion rod. It is particularly advantageous if the radius of curvature is larger close to the tooth foot than close to the tooth head and/or if the radius of curvature gradually decreases towards the tooth head. On account of the preferably gradually decreasing radii of curvature, use is made—unlike in the generic prior art—of tooth profiling with tooth flanks curved in an arcuate manner, instead of flat tooth flanks, in order to improve the run-off behavior of the teeth of the toothed wheel on the rack and pinion teeth or end teeth. The altered tooth profiling can allow the cross-sectional area to be increased by more than 10% and the area moments of inertia therefore to be improved over the tooth profile in the generic rack and pinion arrangement. A harmonic and more uniform run-off on the rack and pinion teeth is achieved, compared to the flat tooth flank, on account of the radii of curvature. At the same time, the slip sliding speed can be reduced.

It is particularly advantageous if the radius of curvature is larger close to the tooth foot than close to the tooth head. Also preferably, the radii of curvature on the end tooth, on the one hand, and on the rack and pinion tooth, on the other hand, are in each case the same size as one another even if, distributed over a tooth flank, the radius of curvature in each case varies, in particular gradually decreases towards the tooth head. It is particularly advantageous if the tooth flanks between the tooth foot and tooth head have at least three radius zones having different radii of curvature, between each of which a change in radius is formed. In the relationship between the end tooth and "normal" rack and pinion tooth, it is particularly advantageous if the changes in radius on the end tooth are each positioned lower than the changes in radius on the adjacent rack and pinion tooth which is positioned on the inside in relation to the end tooth, or in relation to all the internal rack and pinion teeth. Also preferably, in the rack and pinion rods and the rack and pinion arrangement formed therewith, the end teeth in the region of the changes in radius can have a greater tooth width than the inner rack and pinion teeth in the region of the same changes in radius. It is also advantageous if the end tooth foot of the end teeth and the tooth foot of the rack and pinion teeth have a substantially identical or exactly the same foot width and/or if the end tooth head of the end tooth and the tooth head of the inner rack and pinion teeth have approximately the same head width in order in this way to ensure the uniform run-off. The end tooth and the adjacently positioned rack and pinion tooth therefore differ preferably primarily in terms of the lower height of the end tooth or the greater distance of the end tooth head from the bearing or sliding surface (upper side) on the carrier bar or the guide bar and also the changes in radius which are positioned correspondingly lower, whereas the width on the tooth head and on the tooth foot is identical in the end tooth and in the rack and pinion tooth.

According to an advantageous configuration, the tooth flank in the region of the tooth foot can extend in a curved manner, in each case with the largest radius of curvature, the largest radius of curvature preferably being about 1.6 times to 2.1 times larger than the tooth height of the inner rack and pinion teeth and/or being about 1.8 times to 2.15 times larger than the tooth foot width of the rack and pinion teeth or end teeth.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
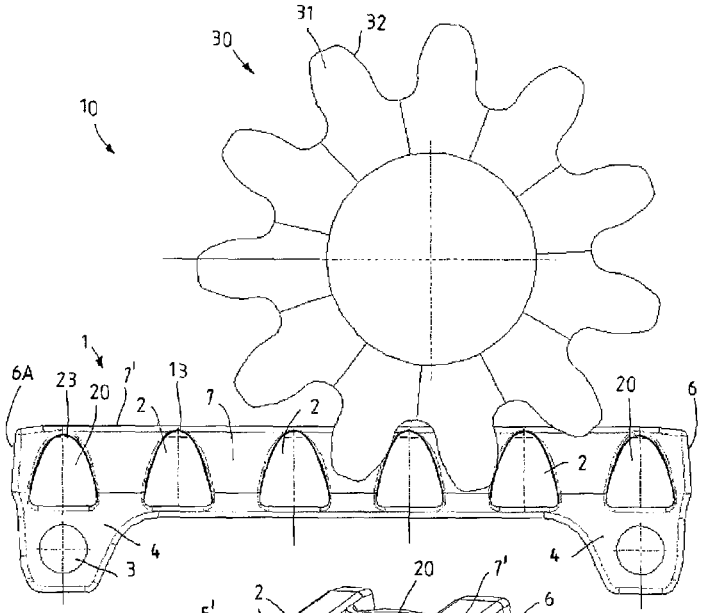
FIG. 1 is a side view of a rack and pinion rod of a rack and pinion arrangement together with a driving sprocket of a travel or feed drive of an extraction machine, the driving sprocket being engaged with the rack and pinion teeth in the rack and pinion rod.

Referring now to the drawings wherein the showings are for the purpose of illustrating preferred and alternative embodiments of the invention only and not for the purpose of limiting same, FIG. 1 shows a rack and pinion arrangement according to the invention is denoted in its entirety by reference numeral 10 although, of the successive rack and pinion rods, of which there is normally a large number, only a single rack and pinion rod 1 is shown. FIG. 1 shows just one rack and pinion rod 1. As a face can generally have a face length of between usually 100 m and now more than 400 m, it will be understood that a rack and pinion arrangement 10 consists of a large number of identically constructed rack and pinion rods 1 succeeding one another in series in order to be able to move the extraction machine back and forth between both face ends. Both the left end 6A and the right end 6 of the illustrated rack and pinion rod 1 are therefore generally adjoined by a further rack and pinion rod having an identical construction or almost identical construction and if appropriate a different total length of the rack and pinion rod 1.

FIG. 1 also shows a driving sprocket 30 having at its circumference in this case eleven teeth 31 which are formed identically to one another and distributed uniformly over the circumference, the tooth flank parts 32 of which teeth are designed so as to be convexly arched in the manner of a cycloid toothing formation. The driving sprocket 30 is connected to a rotary drive which is fastened to a mining extraction machine (not shown) such as in particular a shearer loader, a corresponding shearer loader generally having two driving sprockets 30 which are arranged set apart from each other and have associated rotary drives in order to achieve the feed and travel drive of the shearer loader relative to the rack and pinion arrangement 10. The toothed wheels 31 of the driving sprocket 30 mesh with rack and pinion teeth 2 of the rack and pinion rod 1 which can be fastened via bolt connections, which pass through bolt holes 3 on lower coupling attachments 4 of the rack and pinion rod 1, to bearing brackets (not shown) which are in turn attached, as a rule on the goaf side, such as is generally known to the person skilled in the art in underground mining, to trough pans of a face conveyor so that, on the one hand, the extraction machine can move parallel to the face and extract at a working face minerals such as in particular coal and at the same time the face conveyor can be used to remove the material excavated using the shearer loader.

Figure 2:
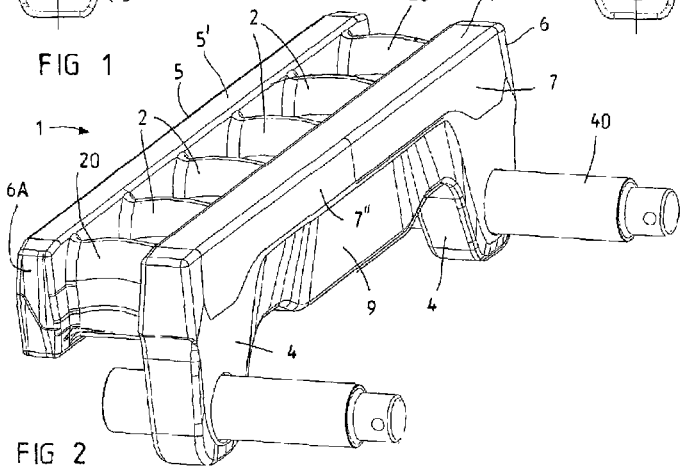
FIG. 2 is a perspective view of a rack and pinion rod according to the invention, looking onto the back of the carrier bar.
Figure 3:
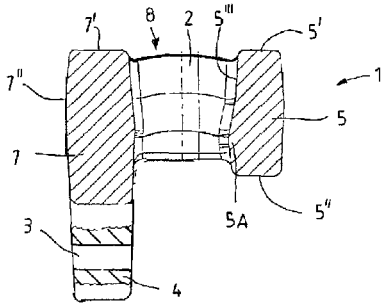
FIG. 3 is a, partly exploded, vertical section through a rack and pinion rod according to the invention.

As FIGS. 2 and 3 in particular show, each rack and pinion rod 1 consists of a relatively strong carrier bar 7, at the ends of which in each case a downwardly protruding coupling attachment 4 is embodied with the bolt hole 3 for passing through a fastening bolt 40 shown in FIG. 2. Each rack and pinion rod 1 further consists of a guide bar 5 which extends at a distance from the carrier bar 7 and parallel thereto and does not have any coupling attachments, and also of a plurality of rack and pinion teeth 2 which are in this case each forged or welded onto the mutually facing bar surfaces of the carrier bar 7 and the guide bar 5. The upper side 7' of the carrier bar 7 and the upper side 5' of the guide bar 5 form a bearing surface for a guide shoe, the bearing surface being used to guide the mining extraction machine on the rack and pinion rod 1. As the underside 5" of the guide bar 5 does not have any coupling attachments, a guide shoe of this type can reach under the guide bar 5 and furthermore also reach behind the carrier bar 7 in order to achieve targeted guidance and above all secured tooth engagement between the teeth of the driving sprocket (30, FIG. 1) and the rack and pinion teeth 2 of the rack and pinion rod 1.

Furthermore, FIGS. 2 and 3 clearly show that the guide bar 5 is wider close to the underside 5" than in the region of the upper side 5', as the guide bar is provided on the inner surface 5'" facing the carrier bar 7 with a protrusion 5A which downwardly slightly tapers the engagement gap 8 between the mutually facing surfaces of the carrier bar 7 and the guide bar 5. Furthermore, this protrusion 5A allows the forging or welding-on of the rack and pinion teeth 2 to be improved in an exact position which remains the same from the rack and pinion tooth 2 to the rack and pinion tooth 2. The back 7" of the carrier bar 7, the back being positioned turned away from the guide bar 5, is, as may clearly be seen from FIG. 2, provided centrally and between, albeit above, the coupling attachments 4 with an indentation 9 via which the carrier bar 7 can if appropriate additionally be supported on mating surfaces of a face conveyor or the like.

A feature that is important to the invention of the rack and pinion rods 1, and to this extent also of the rack and pinion arrangement 10 as a whole, consists in the configuration of the rack and pinion teeth 2 and in particular of an end tooth 20 as a rack and pinion tooth having a special design, this end tooth 20 having in each case, as FIG. 1 clearly shows, a lower height than an adjacently positioned rack and pinion tooth 2 of "normal" design. This lower height is also apparent from the fact that the end tooth has an end tooth head 23 which is at a greater distance from the upper side 7' of the carrier bar 7 than is the tooth head 13 of the adjacently positioned rack and pinion tooth 2. A second feature which is of importance to the invention, wherein both features which are important to the invention can also be used independently of each other, consists in the profiling of the tooth profile of the tooth flanks of the end teeth 20 and rack and pinion teeth 2, and this is will now be described with additional reference to FIG. 4.

Figure 4:
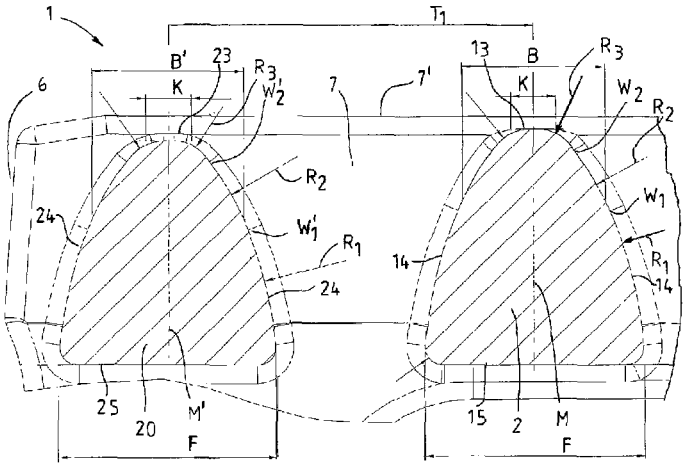
FIG. 4 is a longitudinal section of the end of a rack and pinion rod according to the invention with an inner rack and pinion tooth and also an end tooth.

FIG. 4 shows just one end of a rack and pinion rod 1 and the section through the rack and pinion rod 1 lies centrally between the carrier bar 7 and the guide bar (not shown in this view). It is particularly clear from FIG. 4 that the tooth head 23 is, on account of the lower height of the end tooth 20, at a greater distance from the upper side 7' of the carrier bar 7 than the tooth head 13 of the rack and pinion tooth 2. The rack and pinion tooth 2 has two tooth flanks 14 which point in the direction of movement of the mining extraction machine and are formed symmetrically to a vertical tooth center plane M, and even the end tooth 20 has on both sides a respective end tooth flank 24, both end tooth flanks 24 being embodied symmetrically to the vertical end tooth center plane M'. Both the tooth flank 14 of each rack and pinion tooth 2 and the end tooth flank 24 of the end tooth 20 extend so as to be curved in an arcuate manner over the entire height from the tooth foot 15 or end tooth foot 25 up to the tooth head 13 or end tooth head 23, the end tooth flank 24 and the tooth flanks 14 or the tooth flanks 14 of adjacent rack and pinion teeth diverging relative to one another towards the tooth head 13 or end tooth head 23. Both the rack and pinion tooth 2 and the end tooth 20 have a first, lower radius zone which extends in each case so as to be curved with the radius of curvature R1, which first radius zone is adjoined by a second radius zone which extends, both in the end tooth 20 and in the rack and pinion tooth 2, so as to be curved with the radius of curvature R2, and a third radius zone which has the radius of curvature R3 and merges with the tooth head 13 or end tooth head 23. Despite the lower total height of the end tooth 20, the radii of curvature R1, R2, R3 are the same size in the rack and pinion tooth 2 and in the end tooth 20; the change in radius W1 or W1' between the largest radius of curvature R1, which adjoins in each case the tooth foot 15 or end tooth foot 25, takes place at different heights based on the tooth head 13 or end tooth head 23 or the tooth foot 15 or end tooth foot 25 respectively. As may clearly be seen from FIG. 4, the change in radius W1 in the rack and pinion tooth 2 between the radii R1 and R2 is positioned much higher than the change in radius W1' in the end tooth 20. Equally, the change in radius W2' in the end tooth 20 is also positioned lower or, based on the upper side 7' of the carrier bar, set further apart therefrom than the change in radius W2 between the radii R2, R3 in the rack and pinion tooth 2. Equally, the rack and pinion teeth 2 and the end teeth 20 have the same foot width F or tooth foot width F, and even the actual tooth head 13 or end tooth head 23 has in each case the same head width K. The radius R1 can be approximately preferably twice as large as the foot width F; the radius R2 can be preferably 1.1 times to 1.2 times larger than the foot width F and the radius R3 is preferably 0.15 times to 0.25 times smaller than the foot width F. On account of the different vertical position of the changes in radius Wl, W1', the end tooth 20 at the level of the lower change in radius W1' has a greater tooth width B' than the rack and pinion tooth 2 in the region of the change in radius W1, as a comparison of the tooth widths B, B' clearly reveals. The distance of the tooth center planes M from one another or the distance of the tooth center plane M from the end tooth center plane M' corresponds to the pitch $T_1$ in the rack and pinion rod 1, FIG. 4 showing a rack and pinion rod having an average pitch dimension which is in this case about 1.6 times the tooth foot width F. As will be described hereinafter, the pitch dimension T between the rack and pinion teeth 2 (or between the rack and pinion tooth 2 and end tooth 20) can differ from application to application, an identical pitch dimension T generally existing at least on a rack and pinion rod between all the rack and pinion teeth 2 and also towards the end tooth 20. The rounding of the tooth flanks 14 and 24 respectively causes a widening of the rack and pinion teeth 2 in relation to the prior art, thus reducing the wear during interacting of the teeth of the driving sprocket and the rack and pinion teeth 2 of the rack and pinion rod 1.

The interacting between the teeth 31 of the driving sprocket 30 and the rack and pinion teeth 2 or end teeth 20 at the pitch joint between successive rack and pinion rods will now be described with reference to FIG. 5A to 5D for a rack and pinion rod 51 having a relatively small pitch dimension and in FIGS. 6A, 6B, 6C, 6D for a rack and pinion rod 101 having a relatively large pitch dimension. The pitch dimension in FIG. 5A to 5D is about 1.55 times the tooth foot width and the pitch dimension in FIGS. 6A, 6B, 6C, 6D is about 1.95 times the tooth foot width. The tooth foot width may in particular be about 90 mm, resulting in radii of curvature R1 of about 180 mm, R2 of about 100 mm and R3 of about 16 mm.

Figure 5A:
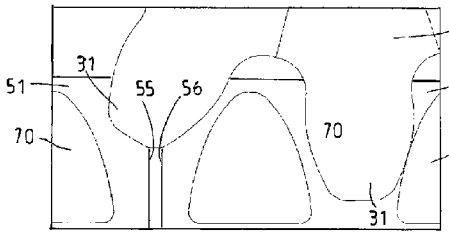
FIG. 5A-5D shows the meshing of the driving sprocket with the rack and pinion teeth of two successive rack and pinion rods in rack and pinion rods having a comparatively small pitch dimension.
Figure 5B:
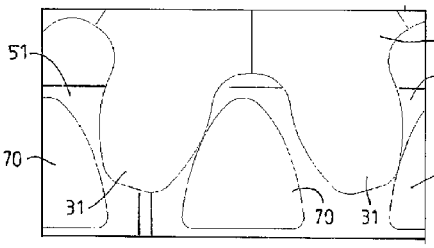
Figure 5C:
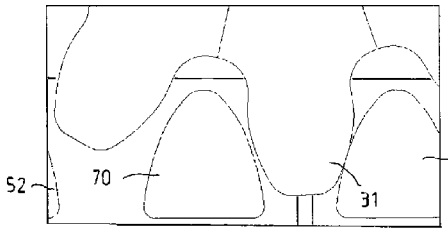
Figure 5D:
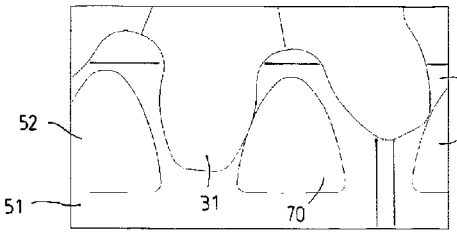

Reference will now firstly be made to FIGS. 5A to 5D which show the run-off of the toothed wheel 30 at the joining point between two successive rack and pinion rods 51. The toothed wheel 30 rotates in the anticlockwise direction and the direction of advancement is in each case to the left. The rack and pinion teeth having the larger or normal overall height are denoted in these figures by reference numeral 52 and the end teeth are each denoted by reference numeral 70, the end teeth 70 each being positioned close to the ends 55 and 56 respectively of the rack and pinion rod 51. In FIG. 5A the flank profile of the bottom tooth 31 of the driving sprocket 30 still rests completely against the last rack and pinion tooth 52 of normal size and the very next tooth 31 of the driving sprocket 30 in the direction of movement is not yet in contact with the end tooth 70. Only in FIG. 5B do the leading tooth 31 of the driving sprocket rest against the rack and pinion tooth 52 and the trailing tooth 31 rest against the end tooth 70. There is not yet any contact with the end tooth 70 of the next rack and pinion rod 51, nor is there any such contact when, as shown in FIG. 5C, the tooth 31 reaches into the pitch gap between the two adjacently positioned end teeth 70 of two successive rack and pinion rods 51. As the pitch dimension between the end tooth 70 and the adjacently positioned rack and pinion tooth 52 is relatively low, the tooth 31 almost completely fills out the intermediate space between the rack and pinion tooth 52 and end tooth 70. Furthermore, FIG. 5C clearly shows that even in this extreme situation the driving sprocket 30 with its teeth 31 still has enough space to rotate without producing jamming between the teeth 31 of the driving sprocket and the end teeth 70 of the rack and pinion rods 51. It may be seen from FIG. 5D that as soon as the driving sprocket 30 has overcome the joint or pitch gap between two rack and pinion rods 51, the next tooth 31 of the driving sprocket 30 can roll in cleanly on the first end tooth 70 of the subsequent rack and pinion rod 51 without the risk that said tooth might rotate in a load-free manner. At the narrow pitch dimension, although a relatively close rolling of the teeth 31 of the driving sprocket past the rack and pinion teeth 52 or end teeth 70 is achieved, jamming, and to this extent intensified wear, can be prevented.

Figure 6A:
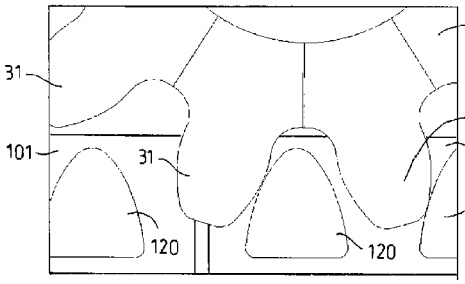
FIG. 6A-6D shows the meshing of the same driving sprocket with the rack and pinion teeth of two successive rack and pinion rods in different sequences in rack and pinion rods having a relatively large pitch between the rack and pinion teeth.
Figure 6B:
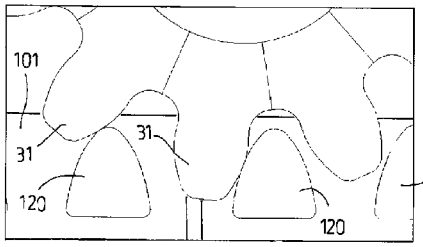
Figure 6C:
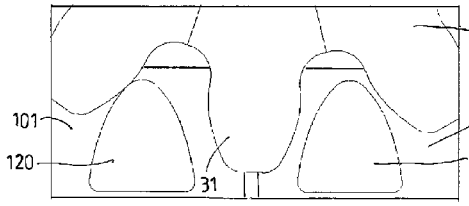
Figure 6D:
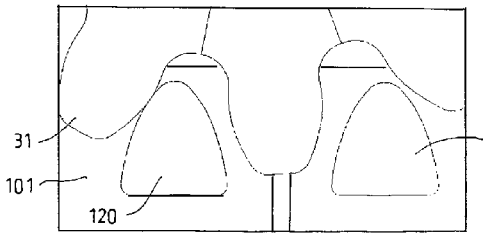

FIG. 6A to 6D show the same situation between a driving sprocket 30 with teeth 31 of the same size and also rack and pinion rods 101 in which the pitch dimension is much larger and is in this case almost twice the tooth foot width. In FIG. 6A a front flank zone of the leading tooth 31 of the driving sprocket 30 still rests against the rack and pinion tooth 102 and the trailing tooth 31 already rests, close to its maximum arching, against that region of the end tooth 120 that is arched with the radius of curvature R2. On onward rotation, the leading tooth 31 comes loose, as FIG. 6B shows, of the rack and pinion tooth 2 substantially at the point in time at which the next tooth 31 is already rolling off the end tooth 120 of the subsequent rack and pinion rod 101. This effect allows the driving sprocket 30 to be moved, as may clearly be seen in FIG. 6C, in an additional onward movement and to draw a certain distance onto the end tooth 120 of the subsequent rack and pinion rod 101, the leading tooth 31 of the driving sprocket 30 already coming loose from the end tooth 120 of the preceding rack and pinion rod 101 at the same time. During onward rolling of the driving sprocket 30, the tooth 31, which is now still in tooth engagement with the end tooth 120 of the next rack and pinion rod 101, can therefore roll off the tooth flank thereof and jamming of the driving sprocket 30 is reliably prevented, in particular at the pitch gap.

The foregoing description reveals to the person skilled in the art numerous modifications which are intended to fall within the scope of protection of the appended claims. The figures do not show that the rack and pinion rods can be mounted, in particular on one side, in slotted brackets in order not only to improve the course of the rack and pinion arrangement in depressions and saddles, but if appropriate also to allow a certain play of the rack and pinion rods. In the case of a different tooth shape of the teeth of the driving sprocket, the profiling of the rack and pinion teeth and end teeth may also be slightly different. For the improvement of the interacting in the overrun ends of the pitch gap between two successive rack and pinion rods, it may be sufficient for a rack and pinion tooth of normal overall height to be adjoined by an end tooth of lower overall height. The profiling of the further rack and pinion teeth may if appropriate also differ slightly.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A rack and pinion arrangement for advancing a mining extraction machine provided with a travel drive having a toothed driving sprocket, in particular of a shearer loader, the rack and pinion arrangement comprising;

a rack and pinion rod, the rack and pinion rod including a carrier bar, a guide bar and also a plurality of inner rack and pinion teeth, the tooth flanks of which diverge from one another, for interaction of a tooth profile of the inner rack and pinion teeth with teeth of an associated driving sprocket, towards the tooth head and which are arranged with a predefined pitch dimension relative to one another between the carrier bar and the guide bar; and a respective end tooth being arranged at both ends of the rack and pinion rod;

wherein the end tooth profile of the end tooth has a change in radius of curvature, and the tooth profile of the inner rack and pinion teeth has a change in radius of curvature, and the change in radius of curvature of the end teeth is positioned lower than the change in radius of the inner rack and pinion teeth, and the end tooth head of the end teeth is positioned lower than the tooth heads of the inner rack and pinion teeth, and the end tooth in the region of the change in radius of curvature has a greater tooth width than the inner rack and pinion teeth in the region of the change in radius of curvature.

2. The rack and pinion arrangement according to claim 1, wherein the end teeth have an end tooth profile with end tooth flanks, an end tooth head and an end tooth foot formed symmetrically to the end tooth center plane, and the inner rack and pinion teeth have tooth flanks, a tooth head and a tooth foot formed symmetrically to the tooth center plane.

3. The rack and pinion arrangement according to claim 2, wherein at least one of the tooth flanks of the inner rack and pinion teeth and the end tooth flanks of the end teeth extend in a curved manner.

4. The rack and pinion arrangement according to claim 3, wherein the tooth flanks of the inner rack and pinion teeth have a first tooth flank radius of curvature near the tooth foot and a second tooth flank radius of curvature near the tooth head, and the end tooth flanks of the end teeth have a first end tooth flank radius of curvature near the end tooth foot and a second end tooth flank radius of curvature near the end tooth head, the first tooth flank radius being greater than the second tooth flank radius and the first end tooth flank radius being greater than the second end tooth flank radius.

5. The rack and pinion arrangement according to claim 4, wherein the radii of curvature on the end tooth and on the inner rack and pinion tooth are each the same size.

6. The rack and pinion arrangement according to claim 3, wherein at least one of the tooth flanks between the tooth foot and tooth head and the end tooth foot and end tooth head have at least three radius zones having different radii of curvature, between each of which a change in radius is formed.

7. The rack and pinion arrangement according to claim 3, wherein the tooth flanks near the tooth foot extend in a curved manner, in each case with a radius of curvature, the radius of curvature being at least one of about 1.6 times to 2.1 times larger than a tooth height of the inner rack and pinion teeth and about 1.8 times to 2.1 times larger than a tooth foot width of the inner rack and pinion teeth.

8. The rack and pinion arrangement according to claim 2, wherein the end tooth foot of the end teeth and the tooth foot of the inner rack and pinion teeth have a substantially the same foot width.

9. The rack and pinion arrangement according to claim 2, wherein the end tooth head of the end teeth and the tooth head of the inner rack and pinion teeth have approximately the same head width.

10. A rack and pinion rod for rack and pinion arrangements for advancing mining extraction machines provided with a travel drive having a toothed driving sprocket, in particular shearer loaders, the rack and pinion rod comprising:

a carrier bar, a guide bar and also a plurality of inner rack and pinion teeth, the tooth flanks of which diverge from one another, for interaction of a tooth profile of the rack and pinion teeth with teeth of an associated driving sprocket, towards the tooth head and which are arranged with a predefined pitch dimension relative to one another between the carrier bar and the guide bar;

a respective end tooth being arranged at both ends of the rack and pinion rod, the end tooth profile of the end tooth differing from the tooth profile of the inner rack and pinion teeth arranged between the end teeth, the end teeth are formed symmetrically to a vertical end tooth center plane and the end tooth head of the end teeth is positioned lower than the tooth heads of the inner rack and pinion teeth;

wherein the guide bar has a protrusion near a lower inner surface, the protrusion extending substantially along a length of the guide bar and configured to position the end teeth and the inner rack and pinion teeth;

wherein at least one of the tooth flanks between the tooth foot and tooth head and the end tooth foot and end tooth head have at least three radius zones having different radii of curvature, between each of which a change in radius is formed; and wherein the end tooth in the region of the changes in radius has a greater tooth width than the inner rack and pinion teeth in the region of the same changes in radius.

11. The rack and pinion rod according to claim 10, wherein the end teeth have an end tooth profile with end tooth flanks, an end tooth head and an end tooth foot formed symmetrically to the end tooth center plane, and the inner rack and pinion teeth have tooth flanks, a tooth head and a tooth foot formed symmetrically to the tooth center plane.

12. The rack and pinion rod according to claim 11, wherein at least one of the tooth flanks of the inner rack and pinion teeth and the end tooth flanks of the end teeth extend in a curved manner.

13. The rack and pinion rod according to claim 12, wherein the tooth flanks of the inner rack and pinion teeth have a first tooth flank radius of curvature near the tooth foot and a second tooth flank radius of curvature near the tooth head, and the end tooth flanks of the end teeth have a first end tooth flank radius of curvature near the end tooth foot and a second end tooth flank radius of curvature near the end tooth head, the first tooth flank radius being greater than the second tooth flank radius and the first end tooth flank radius being greater than the second end tooth flank radius.

14. The rack and pinion rod according to claim 13, wherein the radii of curvature on the end tooth and on the inner rack and pinion tooth are each the same size.

15. The rack and pinion rod according to claim 12, wherein the tooth flanks near the tooth foot extend in a curved manner, in each case with a radius of curvature, the radius of curvature being at least one of about 1.6 times to 2.1 times larger than a tooth height of the inner rack and pinion teeth and about 1.8 times to 2.1 times larger than a tooth foot width of the inner rack and pinion teeth.

16. The rack and pinion rod according to claim 11, wherein the end tooth foot of the end teeth and the tooth foot of the inner rack and pinion teeth have a substantially the same foot width.

17. The rack and pinion rod according to claim 11, wherein the end tooth head of the end teeth and the tooth head of the inner rack and pinion teeth have approximately the same head width.

18. The rack and pinion rod according to claim 10, wherein the changes in radius on the end tooth are positioned lower than the changes in radius on the inner rack and pinion teeth.

* * * * *